US007911297B2

(12) United States Patent
Tachibana et al.

(10) Patent No.: US 7,911,297 B2
(45) Date of Patent: Mar. 22, 2011

(54) FILTER DEVICE AND METHOD FOR MANUFACTURING THE SAME

(75) Inventors: Minoru Tachibana, Osaka (JP); Hideki Nanba, Kyoto (JP)

(73) Assignee: Panasonic Corporation, Osaka (JP)

( * ) Notice: Subject to any disclaimer, the term of this patent is extended or adjusted under 35 U.S.C. 154(b) by 147 days.

(21) Appl. No.: 12/376,162

(22) PCT Filed: Aug. 23, 2007

(86) PCT No.: PCT/JP2007/066329

§ 371 (c)(1),
(2), (4) Date: Feb. 3, 2009

(87) PCT Pub. No.: WO2008/026493

PCT Pub. Date: Mar. 6, 2008

(65) Prior Publication Data

US 2010/0007446 A1 Jan. 14, 2010

(30) Foreign Application Priority Data

Aug. 31, 2006 (JP) ..... 2006-235237
Aug. 31, 2006 (JP) ..... 2006-235238

(51) Int. Cl.
*H01P 1/205* (2006.01)

(52) U.S. Cl. ..... 333/206; 333/222

(58) Field of Classification Search ..... 333/219, 333/222, 223, 224, 225, 226, 235, 234, 202, 333/203, 206, 207

See application file for complete search history.

(56) References Cited

U.S. PATENT DOCUMENTS

| | | | | |
|---|---|---|---|---|
| 6,002,311 | A * | 12/1999 | Wey et al. | 333/219.1 |
| 6,114,928 | A * | 9/2000 | Smith | 333/202 |
| 2003/0174030 | A1 | 9/2003 | Chopra et al. | |
| 2006/0103493 | A1 | 5/2006 | Kley et al. | |
| 2007/0194865 | A1 * | 8/2007 | Weitzenberger et al. | 333/206 |

FOREIGN PATENT DOCUMENTS

| | | |
|---|---|---|
| EP | 0673077 | 9/1995 |
| EP | 0859422 | 8/1998 |
| JP | 58-84503 | 5/1983 |
| JP | 3-058501 | 3/1991 |
| JP | 5-183305 | 7/1993 |
| JP | 8-195607 | 7/1996 |
| JP | 2000-114809 | 4/2000 |
| JP | 2006-510243 | 3/2006 |
| WO | 03/088407 | 10/2003 |

(Continued)

OTHER PUBLICATIONS

European Search Report issued Oct. 28, 2009 in the corresponding European Application No. 07792907.

(Continued)

*Primary Examiner* — Stephen E Jones
(74) *Attorney, Agent, or Firm* — Wenderoth, Lind & Ponack, L.L.P.

(57) ABSTRACT

A filter device having a frame made of plated steel sheet generates a smaller insertion loss and is excellent in productivity. Resonant elements are shaped into a cylindrical form by bending the steel sheet, whose both sides are plated, before they are placed in a filter housing. A gap formed on a lateral face of each resonant element is brazed with solder, and an outer plated face of each resonant element is brazed with solder to an inner plated face of the frame.

9 Claims, 9 Drawing Sheets

FOREIGN PATENT DOCUMENTS

WO 2004/054033 6/2004

OTHER PUBLICATIONS

Thomas, J. "Cross-Coupling in Coaxial Cavity Filters—A Tutorial Overview" IEEE Transactions on Microwave Theory and Techniques, IEEE Service Center, Piscataway, NJ, vol. 51, No. 4, Apr. 1, 2003, pp. 1368-1376.

International Search Report issued Nov. 6, 2007 in the International (PCT) Application of which the present application is the U.S. National Stage.

* cited by examiner

FILTER DEVICE AND METHOD FOR MANUFACTURING THE SAME

TECHNICAL FIELD

The present invention relates to a filter device to be used in a micro wave or a sub-micro wave communication apparatus, and a method for manufacturing the same filter device.

BACKGROUND ART

FIG. 12 shows a sectional view of a conventional filter device, which is manufactured through the steps of: machining aluminum die-cast, then providing the machined die-cast with silver plating to produce frame 1, and then screwing resonant element 2 into frame 1, and finally putting lid 3 onto frame 1.

Unexamined Japanese Patent Application Publication No. H08-195607 is known as related art to the present invention.

Screwing of the resonant element to the frame produces dispersion in electrical resistance at the connected section depending on the tightening force. The dispersion will lower a Q factor of the resonator formed of the inside of the frame and the resonant element mounted in the frame. This phenomenon resultantly degrades the characteristics of the filter device, such as incurring a greater insertion loss.

SUMMARY OF INVENTION

The present invention addresses the problem discussed above, and aims to provide a filter device excellent in characteristics of, e.g. insertion loss. To achieve the foregoing objective, the filter device of the present invention comprises the following elements:

a filter housing formed of a frame opening at least in its upside (i.e., having an upward opening in an upper side thereof) and a lid covering the opening of the frame and mounted to the frame, and the housing being provided with a face plated at least on its inside; and a resonant element placed in the filter housing.

The resonant element employs steel sheet whose both faces are plated, and the plated steel sheet is bent and shaped into a cylindrical form. A gap formed on a lateral face of the resonant element is brazed with a bonding member, and the outer plated face of the resonant element and the inner plated face of the frame are brazed with a bonding member.

The resonant element is thus brazed with conductive bonding material, thereby reducing a connection resistance between the resonant element and the frame. As a result, the Q factor of the resonator can be increased, so that a filter device having a smaller insertion loss is obtainable.

Use of the plated steel sheet allows a thickness of the filter device to be thinner, thereby reducing a weight thereof. On top of that, the plated steel sheet can be shaped by press-working, which assures high productivity, and the filter device thus can be produced at an inexpensive cost.

DETAILED DESCRIPTION OF THE INVENTION

Exemplary Embodiment 1

Figure 1:
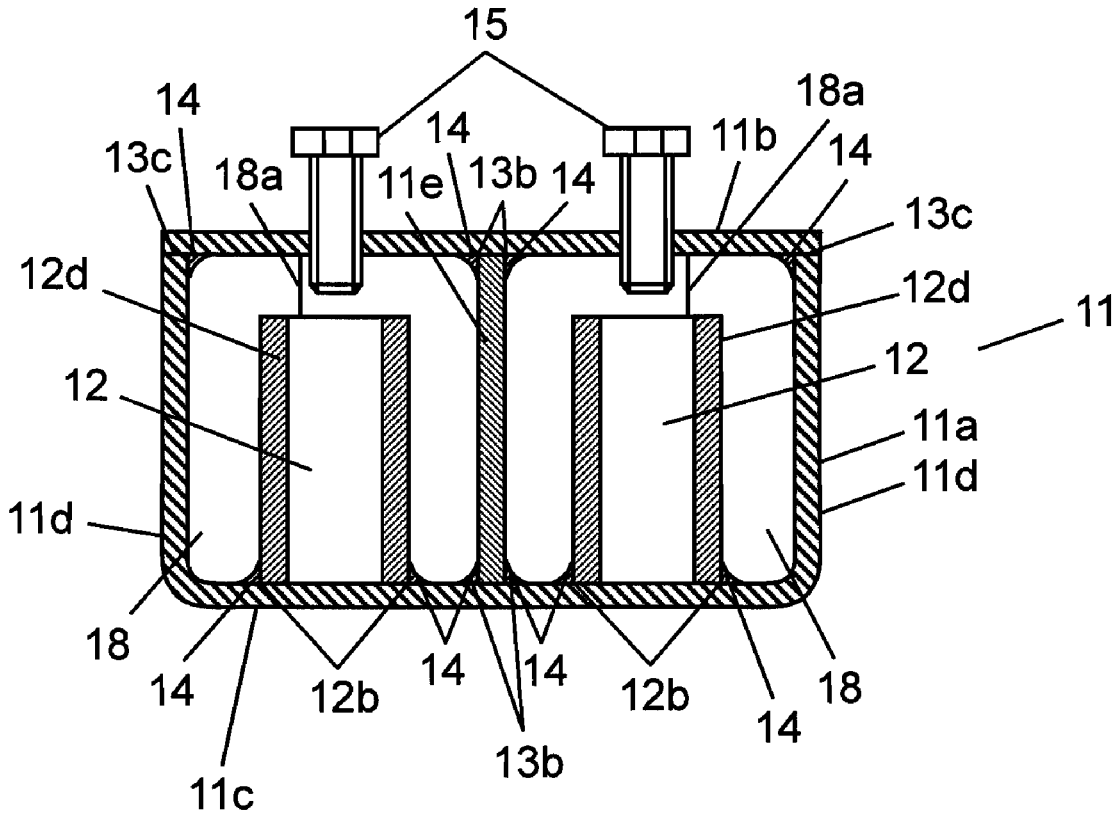
FIG. 1 shows a sectional view of a filter device in accordance with a first embodiment of the present invention.
Figure 2:
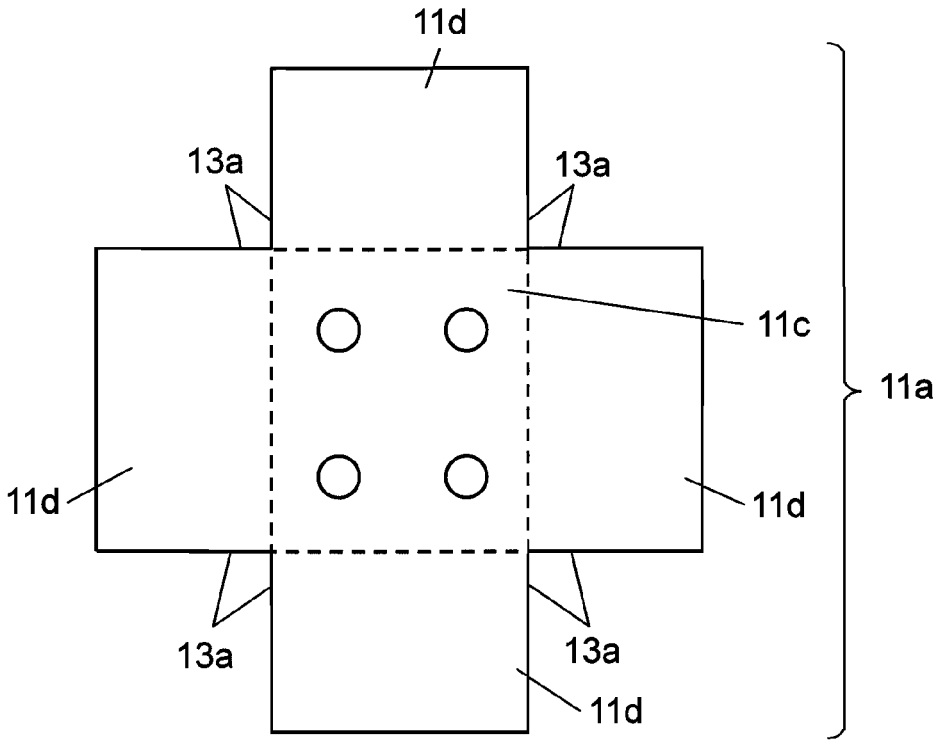
FIG. 2 shows a development view of a frame of the filter device shown in FIG. 1.

The first embodiment is demonstrated hereinafter with reference to the accompanying drawings. FIG. 1 shows a sectional view of a filter device in accordance with the first embodiment, and FIG. 2 shows a development view of frame 11*a* of the filter device shown in FIG. 1. In FIG. 1 and FIG. 2, frame 11*a* is made of steel sheet which has been plated with copper and then shaped into a given form by cutting and bending. Filter housing 11 used in this first embodiment is formed of frame 11*a* and lid 11*b*. Frame 11*a* is cut into a shape as shown in FIG. 2 and bent along the dotted lines. Frame 11*a* thus forms a box-like shape with bottom 11*c* and four side plates 11*d* bent along the four edges of bottom 11*c*, rising from the edges and crossing with each other at approx. right angles.

Lid 11*b* is mounted to frame 11*a* such that it covers the opening of frame 11*a*. In this embodiment, frame 11*a* is brazed to lid 11*b* with solder 14 (used as an example of the bonding material). Lid 11*b* includes screw holes at the places above resonant elements 12. Frequency adjusting screws 15 are put into these screw holes. In this first embodiment, lid 11*b* and frame 11*a* employ the same plated steel sheet, whose thickness is approx. 1 mm.

Side plates 11*d* bent along the dotted lines shown in FIG. 2 are joined together, and the jointed section is referred to as connected section 13*a*, where side plates 11*d* adjacent to each other are connected and fixed together with solder 14. In this embodiment, the steel sheet is copper-plated in a thickness of approx. 10 μm.

Figure 3A:
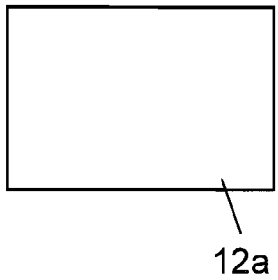
FIG. 3A shows a development view of a resonant element to be used in the filter device shown in FIG. 1.
Figure 3B:
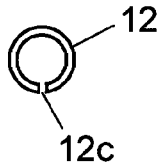
FIG. 3B shows a top view of the resonant element shown in FIG. 3A.
Figure 3C:
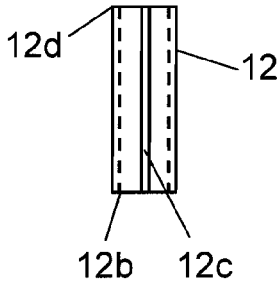
FIG. 3C shows a lateral view of the resonant element shown in FIG. 3A.

FIG. 3A shows a development plan view of resonant element 12 to be used in the filter device discussed above. FIG. 3B shows a top view of resonant element 12, and FIG. 3C shows a lateral view of resonant element 12. In these drawings, resonant element 12 is formed by press-working the copper-plated steel sheet as frame 11*a* is formed, to be more specific, punched-out flat plate 12*a* is bent into a cylindrical form, and shaped into resonant element 12, which is then connected and fixed to bottom 11*c* of frame 11*a* with solder 14.

Filter housing 11 of this embodiment is equipped with four resonant elements 12, which are separated individually with partitions 11*e*. Gaps between partitions 11*e* and side plates 11*d* are brazed with solder 14, thereby connecting partitions 11*e* to side plates 11*d*. Gaps between partitions 11*e* and filter housing 11 (respective gaps between partitions 11*e* and bottom 11*c*, side plates 11*d*, lid 11*b*) are also brazed with solder 14 to form connected sections 13*b*, thereby connecting each other. Gaps between side plates 11*d* and lid 11*b* are brazed with solder 14 to form connected section 13*c*, thereby connecting each other.

Partitions 11*e* cross with each other to form a cross-shape at approx. the center in frame 11. Connected section 13*d* (not shown in FIG. 1 but shown in FIG. 10A) of partitions 11*e* is also brazed with solder 14. Resonant elements 12 are individually placed at the approx. center of each cavity separated by partitions 11*e*.

The foregoing structure allows resonant element 12 to be hollow inside, which makes the weight less than that of a pole-type resonant element. Resonant element 12 can be formed by bending a punched-out flat plate 12*a*, so that gap 12*c* is produced at the joint, so that gap 12*c* is also connected and fixed to each other with solder 14. This structure allows for reducing of an insertion loss of the filter.

In general, electric charges tend to gather at connected sections 13*a*, 13*b*, 13*c*, 13*d*, and connected sections 12*b* between resonant elements 12 and filter housing 11, so that the electric potential at these connected sections become higher. Therefore, it is essential to reduce the resistance at connected sections 12*b*, 13*a*, 13*b*, 13*c*, and 13*d*, and it is desirable to use a metal having the smallest possible resistance as the bonding material.

In this embodiment, solder 14 is employed as brazing material; however, the brazing material can be any metal inasmuch as it has a small resistance, good soldability with a counterpart metal, and is resistive to metallic erosion.

A cut surface resulting from the press-working done to the steel sheet exposes basis metal of the steel sheet, i.e. iron is exposed, so that the basis metal is subject to oxidization or rust with ease, and the resistance on the cut surface grows great. On top of that, since the iron is magnetic material, the resistance becomes greater in a high frequency region. To overcome the foregoing drawbacks, the plated faces are brazed and connected to each other with solder 14 (as the bonding material).

To be more specific, at connected sections 13*a*, plated faces inside the side plates 11*d* are connected to each other with solder 14. At connected sections 13*b*, plated faces on both sides of partition 11*e* are connected to the plated face inside of filter housing 11 with solder 14. At connected sections 13*c*, side plates 11*d* are connected to lid 11*b*, and at connected sections 13*d*, plated faces on the sides of partitions 11*e* are connected to each other. At connected sections 12*b*, plated faces inside bottom 11*c* are connected to the plated faces outside the resonant elements 12 with solder 14. These connections allow for reducing of the resistances at connected sections 12*b*, 13*a*, 13*b*, 13*c*, and 13*d*, so that the Q factor of the resonator can be raised, which reduces a signal loss, and a filter device having a smaller insertion loss is thus achievable.

On top of that, the structure discussed above diminishes the concentration of the electric charges on connected sections 12*b*, 13*a*, 13*b*, 13*c*, and 13*d*. It is generally known that the electric charges gather at an angular section, such as connected sections 12*b*, 13*a*, 13*b*, 13*c*, and 13*d*. A magnitude of the concentration becomes greater as an angle of the angular section becomes acuter, and a tip of the angular section becomes sharper.

The connection between the plated faces with the bonding member allows the tips of the angular sections of connected sections 12*b*, 13*a*, 13*b*, 13*c*, and 13*d* to be round. The bent sections between bottom 11*c* and side plates 11*d* are processed to be round. These preparations allow for diminishing of the concentration of the electric charges on the connected sections 12*b*, 13*a*, 13*b*, 13*c*, and 13*d*, which thus do not so much contribute to the problem discussed previously. The loss in signals can thus be smaller, and the filter device having a smaller insertion loss is achievable.

On top of that, cut surfaces of tips 12*d* of resonant elements 12 are covered with solder 14, so that the cut surfaces are hardly exposed at tips 12*d* where electric charges concentrate among others. Electrical resistance at tips 12*d* can thus be reduced. As a result, use of the plated steel sheet allows for improving of the insertion loss of the filter device.

Frame 11*a* is connected to lid 11*b* with solder 14; however, they can be connected and fixed to each other with screws. In this case, lid 11*b* is detachable, and repair work becomes simpler. Resonant elements 12 are mounted to bottom 11*c*; however, they can be mounted to side plates 11*d* or lid 11*b* instead. It is yet desirable to align the center axis of adjusting screw 15 and the center axis of resonant element 12 generally on a straight line.

A method of manufacturing the filter device discussed above is demonstrated hereinafter. In the press-working step, copper-plated steel sheet is punched out, and then the resultant sheet is bent to form frame 11*a*, lid 11*b*, partitions 11*e*, and resonant elements 12. After the press-working step, the brazing step brazes resonant elements 12, partitions 11*e*, and lid 11*b* to frame 11*a*.

In this brazing step, soldering and assembling are done firstly, namely, after the press-working step, resonant elements 12 and partitions 11*e* are firstly mounted to bottom 11*c* of frame 11*a*, and cream solder 14 is applied to their connected sections 12*b*, 13*a*, 13*b*, 13*c*, and 13*d*. Then lid 11*b* is mounted to frame 11*a*.

In this first embodiment, cream solder 14 is applied to the objects through a dispenser; however, when an object is a flat plate like lid 11*b*, solder 14 can be applied through a screen printing method. In this case, the cream solder 14 can be applied in a stable amount. Stick solder can be used instead of cream solder 14, for a more stable amount of solder can be applied.

In the brazing step, solder 14 is melted by heating after the step of applying solder 14 and assembling, so that resonant elements 12 and lid 11*b* are connected and fixed to frame 11*a*. Connected sections 13*a*, 13*b*, 13*c*, and 13*d* of frame 11*a* are also connected and fixed to the objects with solder 14.

Paste of cream solder 14 is used for brazing; however, stick solder or silver solder can be used for brazing. In the case of using the silver solder, the bonding can be preferably carried out at approx. 900° C. in a reducing furnace. As discussed above, the joining of side plates 11*d* with each other, the joining of bottom 11*c* with resonant elements 12, and covering the gaps 12*c* of resonant elements 12 with solder 14 can be done during the one step, i.e. the brazing step, so that the productivity can be improved.

In an adjustment step following the brazing step, frequency adjusting screw 15 is mounted to lid 11*b*, and a distance between screw 15 and resonant element 12 is adjusted, thereby adjusting the frequency characteristics of the filter device, which is thus completed.

Figure 4A:
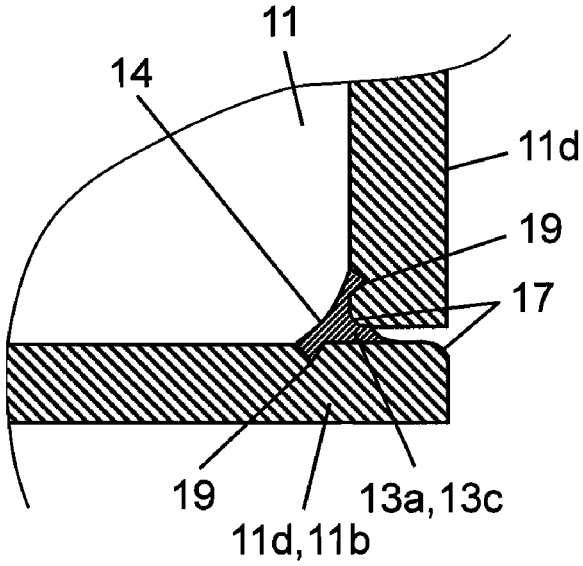
FIG. 4A shows an enlarged sectional view of a connected section bonded only with one side of plated faces.
Figure 4B:
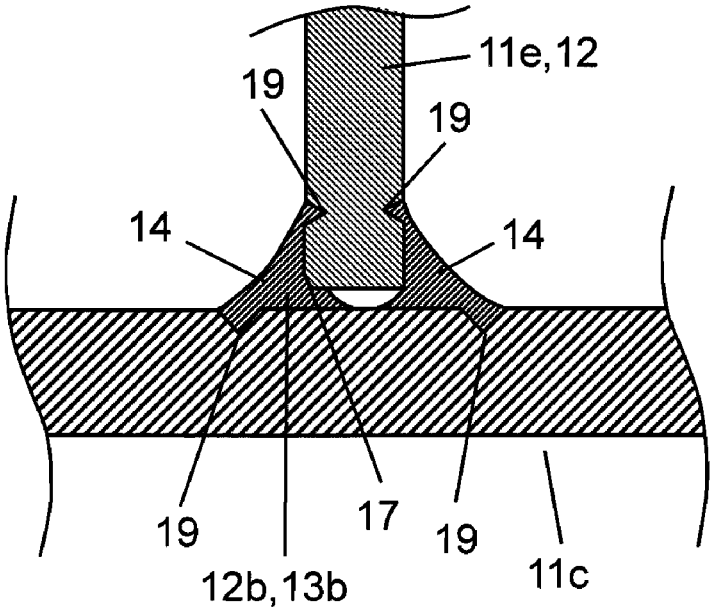
FIG. 4B shows an enlarged sectional view of the connected section bonded with both sides of plated faces.

FIG. 4A shows an enlarged sectional view of the connected section bonded only with one side of plated faces. FIG. 4B shows an enlarged sectional view of the connected section bonded with both sides of plated faces. FIG. 4A shows connected sections 13*a*, 13*c*, and FIG. 4B shows connected sections 12*b*, 13*b*. In FIG. 4A and FIG. 4B, elements similar to those in FIG. 1-FIG. 3C have the same reference marks, and the descriptions thereof are simplified here.

In FIG. 4A and FIG. 4B, when frame 11*a* (or resonant element 12) is press-cut, a clearance of a tooling die for this press-cutting is adjusted for forming regions 17 at connected sections 13*a*-13*d* for introducing the plating material onto the cut surface. This preparation allows for simply connecting the objects to the respective connected sections with solder 14, such as between each side plate 11*d*, between partition 11*e* and lid 11*b*, between partition 11*e* and housing 11, and between housing 11 and resonant element 12.

In this first embodiment, since the plated steel sheet having a cut surface is used, and the cut surfaces of connected sections 12*b*, 13*a*, 13*b*, 13*c*, and 13*d* are placed confronting the plated surfaces. Since the cut surface has poor soldability, solder 14 is prevented from flowing, and thus solder 14 will not spread unnecessarily. A stable and appropriate shape can thus be formed at each one of the connected sections 12*b*, 13*a*, 13*b*, 13*c*, and 13*d*, so that a dispersion of the insertion loss can be minimized.

On top of that, connected sections 12*b*, 13*a*, 13*b*, 13*c*, and 13*d* are provided with V-shaped grooves 19 for preventing solder 14 from flowing and spreading. V-shaped groove 19 prevents melted solder 14 from traversing grooves 19 and spreading, so that a stable and an appropriate size of round shape can be formed at the respective connected sections. Thus a smaller insertion loss and a smaller dispersion thereof can be expected. Instead of V-shaped groove 19, protrusions or resist film can be used for preventing solder 14 from spreading. In the case of using the protrusions, no pointed sections are preferably formed in order to avoid concentration of electric charges thereon.

Regions 17 are also provided to connected sections 12*b* and an outer wall of tip 12*d* of resonant elements 12 for introducing the plated material, because cream solder 14 is applied to tip 12*d* during the soldering and assembling step in this embodiment. This preparation shortens the distance between the inner plated face and the outer plated face of resonant element 12 (distance between the cut surfaces exposed), so that the entire cut surface can be simply covered with melted solder 14. Tip 12*d*, where electric charges tend to concentrate, is covered with solder 14, so that the resistance of tip 12*d* can be reduced. As a result, a filter device having a smaller insertion loss is obtainable.

Partitions 11*e* in accordance with the first embodiment are provided with communicating windows 18 (shown in FIG. 10A) for communicating a cavity with an adjacent cavity. Partitions 11*e* are also provided with the plated material at edges 18*a* (shown in FIG. 10A) confronting the windows, so that the distance between the plated faces is shortened and the resistance can be reduced.

On top of that, cream solder 14 is applied to the cut surfaces of edges 18*a* during the soldering and assembling step, so that the edges, where an electric potential tends to be higher, of partitions 11*e* have a lower resistance. As a result, the filter device having a further smaller insertion loss is obtainable.

Region 17, which introduces the plated material onto the cut surface, desirably has a wider area, and specifically, it is preferable for region 17 to have at least 30% area of the cut surface, and more preferably, it has 50% or more than 50% area of the cut surface. This structure allows the entire cut surface to be covered steadily with solder 14. A greater thickness of the plated surface is desirable in order to introduce the plated material onto the cut surface, and specifically, the thickness of the plated surface is preferably at least 0.5% of a thickness of the plated steel sheet, so that the plated material can be steadily introduced on at least 30% of the area of the cut surface.

It is also preferable to introduce the plated material onto the cut surfaces formed on both sides of gap 12*c* of resonant element 12. In this case, the plated material should be introduced on the outer side of resonant element 12. This preparation allows solder 14 to rise with ease along gap 12*c* toward the top of resonant element 12 due to the capillarity while solder 14 covers the entire cut surfaces, so that gap 12*c* can be brazed with ease. On top of that, the brazing can be done at once, so that the productivity can be greatly improved.

The filter device in accordance with this embodiment generates resonance in the interior space between resonant element 12 and frame 11*a*, thereby forming a resonator, and a combination of these structures produces filter characteristics. In this structure, the inner plated surfaces of filter housing 11 are connected to each other by soldering, and the outer plated surface of resonant element 12 is connected to the inner plated surface of housing 11, thereby reducing electrical resistance in parts of a loop including resonant element 12. The filter having a higher Q factor of the resonator and a smaller insertion loss is thus obtainable.

The plating material and the brazing material preferably have a lower electrical resistance from the viewpoint of characteristics of a filter device, and also these two materials preferably have a greater difference in their melting points. Because a brazing temperature should be set between these melting points, and if the difference between these melting points is small, a viscosity of the brazing material cannot be small enough to spread. Considering this factor, use of copper (melting point is approx. 1050° C.) as the plating material, and use of silver solder (melting point is approx. 800° C.) or solder 14 (melting point is approx. 180-240° C.) will make the viscosity of the brazing material small enough, so that the entire cut surface can be covered steadily with the brazing material.

In this first embodiment, resonant elements 12 are brazed to the bottom of the frame; however resonant elements 12 can be brazed to lid 11*b* or side plates 11*d* for obtaining the same resonant device as discussed above. Frequency adjusting screw 15 is mounted to lid 11*b*; however, it can be mounted to side plate 11*d* or bottom 11*c*. A more accurate frequency adjustment requires screw 15 to be mounted to a face confronting the face where resonant element 12 is mounted. The center of resonant element 12 is preferably aligned with the center of screw 15 on a substantially straight line.

The brazing material can be attached to the entire sections before they are put into the reducing furnace, thereby melting the material in order to spread the brazing material over the entire sections. Another way to spread the material over the entire sections is to link connected sections 12*b*, 13*a*, 13*b*, 13*c*, and 13*s* to the non-connected sections, i.e. the cut sections, with narrow grooves, and then the entire sections are put into the reducing furnace for melting the brazing material. The melted brazing material travels to the non-connected sections through the narrow grooves due to the capillarity. This structure allows the brazing material to cover the entire cut surfaces with ease. Since those grooves can be formed at the same time as the press-working step of frame 11 or resonant elements 12, no additional labor or time is required.

Exemplary Embodiment 2

Figure 5:
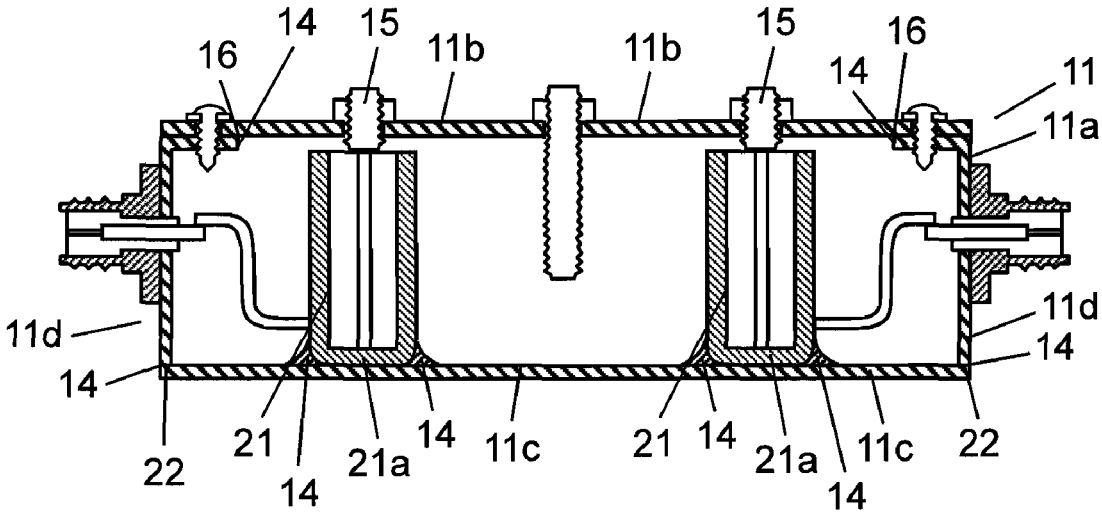
FIG. 5 shows a sectional view of a filter device in accordance with a second embodiment of the present invention.
Figure 6:
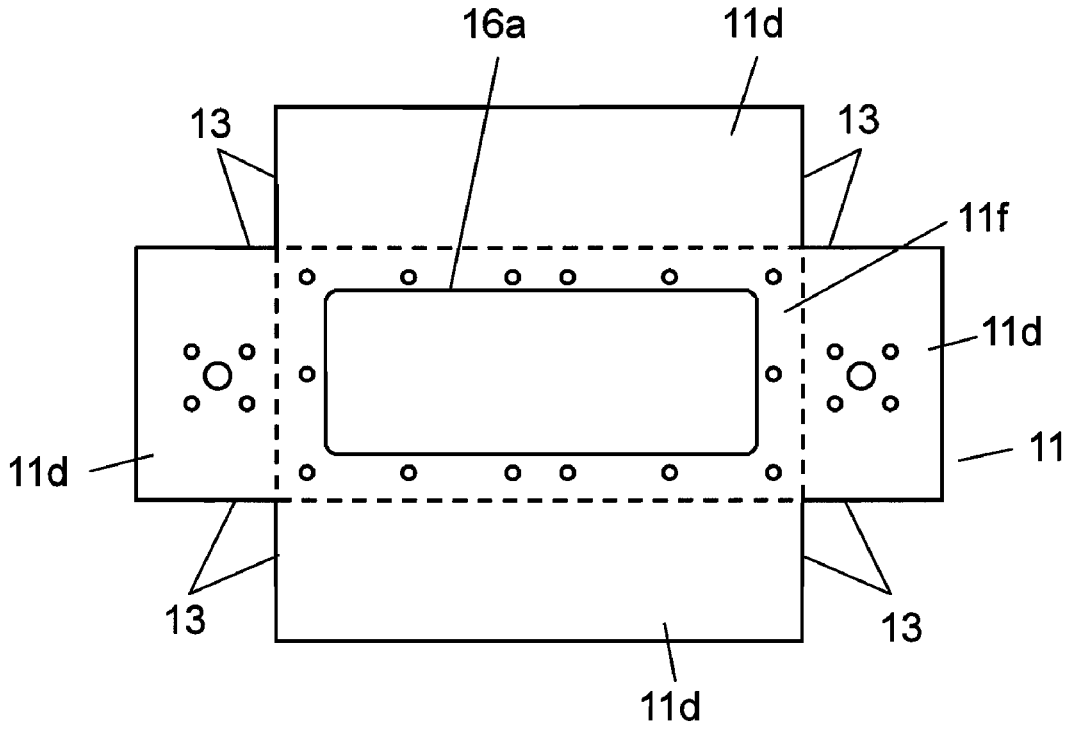
FIG. 6 shows a development view of a frame of the filter device shown in FIG. 5.

The second embodiment is demonstrated hereinafter with reference to the accompanying drawings. FIG. 5 shows a sectional view of a filter device in accordance with the second embodiment of the present invention. FIG. 6 shows a development view of a frame of the filter device shown in FIG. 5. In FIGS. 5 and 6, elements similar to those in FIG. 1 have the same reference marks, and the descriptions thereof are simplified here.

In the first embodiment discussed previously, frame 11*a* is formed of bottom 11*c* and side plates 11*d* bent from bottom 11*c*. In this second embodiment, side plates 11*d*, which are integral with top plate 11*f*, are separated from bottom 11*c*, and four side plates 11*d* are bent at the edges of top plate 11*f* and depend therefrom, so that they open downward. Lid 11*b* is screwed and fixed to top plate 11*f*. Bottom 11*c* is connected to side plates 11*d* with solder 14, thereby forming connected sections 22.

Figure 7A:
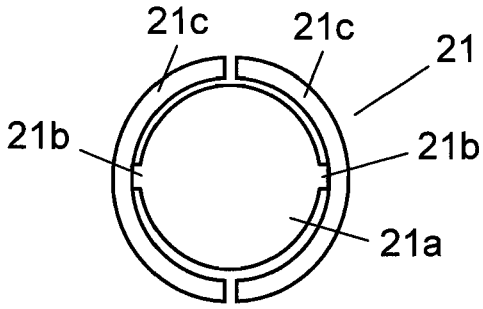
FIG. 7A shows a top view of a resonant element to be used in the filter device shown in FIG. 5.
Figure 7B:
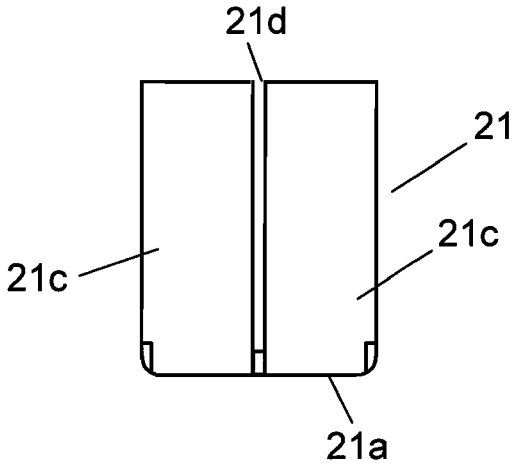
FIG. 7B shows a lateral view of the resonant element shown in FIG. 7A.
Figure 7C:
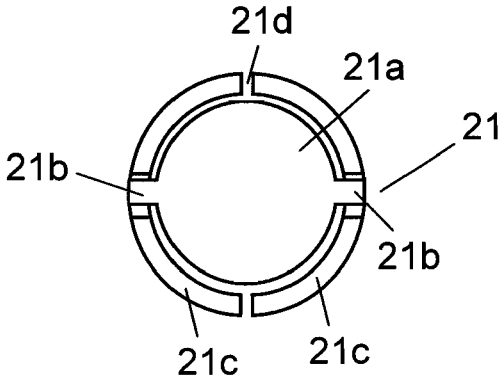
FIG. 7C shows a bottom view of the resonant element shown in FIG. 7A.

Resonant elements 21 are brazed to bottom 11*c* with solder 14, similarly to the first embodiment. FIG. 7A shows a top view of resonant element 21 to be used in the filter device in accordance with the second embodiment. FIG. 7B shows a lateral view of resonant element 21, and FIG. 7C shows a bottom view of resonant element 21. In FIGS. 7A-7C, resonant element 21 is shaped by bending steel sheet through press-working Resonant element 21 comprises the following sections:

mounting plate 21*a;* linking section 21*b* bent from mounting plate 21*a*; and cylindrical section 21*c* linked with linking section 21*b*.

Cylindrical section 21*c* is formed of two semicircles which are formed by bending the steel sheet. Resonant element 21 discussed above is mounted on bottom 11*c* with its mounting plate 21*a* placed on bottom 11*c* and its opening section faced to lid 11*b*. Frame 11*a*, lid 11*b*, and resonant elements 21 are made of steel sheet plated with copper, so that an outer plated face of mounting plate 21*a* and an inner plated face of bottom 11*c* are brazed together by solder 14. Inner plated faces of the tips at the opening side of side plates 11*d* and the inner plated face of bottom 11*c* are also brazed together by solder 14.

Resonant element 21 is obliged to have gap 21*d* between two semicircles of cylindrical sections 21*c*, and gap 21 can be closed with solder 14. As a result, use of plated steel sheet allows for achieving a filter device having a smaller insertion loss. Region 17, similar to that in the first embodiment, is formed at the tip of the outer wall of cylindrical section 21*c*, so that the plated material can be introduced and solder 14 can cover the cut surfaces.

The top face of top plate 11*f* and the underside of lid 11*b* confront each other and are connected together with cream solder 14. Hole 16*a* provided in top plate 11*f* produces a step, and the cut surfaces of hole 16*a* are preferably covered with solder 14.

The cut surface of hole 16*a* is processed such that the plated material can be introduced thereon, so that solder 14 can spread around hole 16*a* with ease, and electric charges will not so much concentrate on the step. As a result, the filter device having smaller insertion loss is obtainable. The plated face is preferably introduced on the side confronting lid 11*b*, because the connected section can be brazed with more ease.

During the step of soldering and assembling in this second embodiment, cream solder 14 is applied firstly to bottom 11*c* and lid 11*b*. To be more specific, cream solder 14 is applied to mounting face 21*a* of resonant element 21, connected section 22 between bottom 11*c* and side plates 11*d*, and lid 11*b* at a section confronting top plate 11*f*.

Since bottom 11*c* and lid 11*b* are flat plates, solder 14 can be applied thereto with ease by a screen printing method, so that excellent productivity can be expected. Solder 14 is applied to lid 11*b*; however, it can be applied to top plate 11*f* at the section confronting lid 11*b*. In this case, since the top face of top plate 11*f* is flat, solder 14 can be applied thereto with ease by the screen printing method.

Then resonant elements 21, partitions (not shown), and side plates 11*d* are mounted to bottom 11*c*, and then cream solder 14 is applied to connected sections 13*a*, 13*b*, 13*c*, 13*d* between each side plate 11*d*.

Exemplary Embodiment 3

Figure 8:
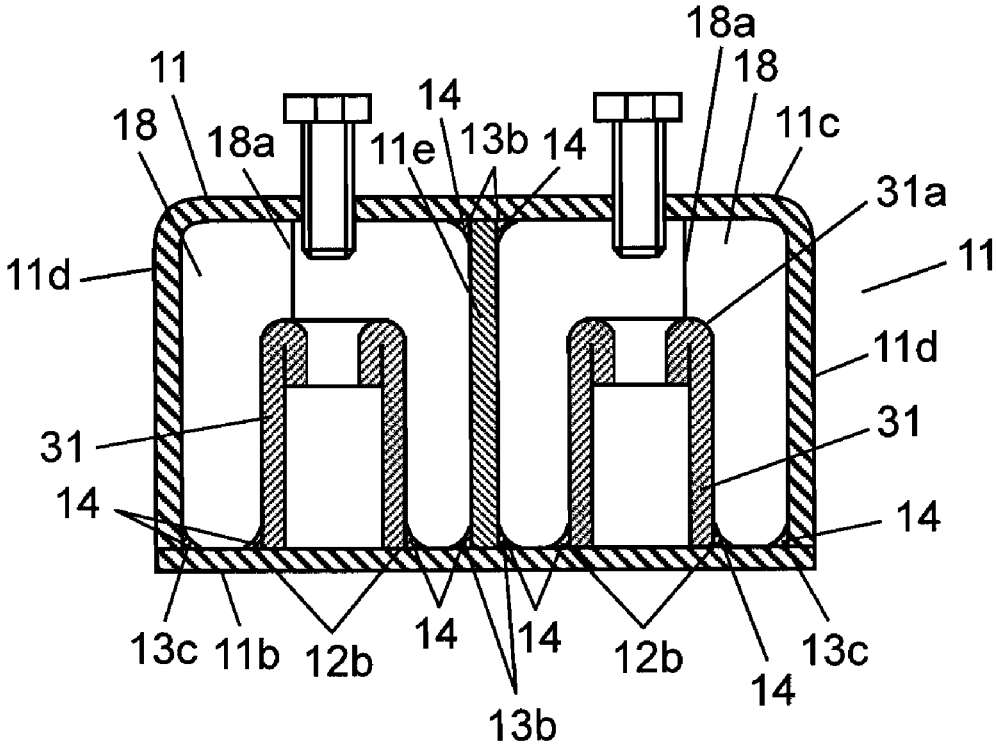
FIG. 8 shows a sectional view of a filter device in accordance with a third embodiment of the present invention.

The third embodiment is demonstrated hereinafter with reference to the accompanying drawings. FIG. 8 shows a sectional view of a filter device in accordance with the third embodiment. The filter device shown in FIG. 8 differs from that of the first embodiment in the following points: Resonant elements 31 are mounted to lid 11*b*, frequency adjusting screws 15 are mounted to bottom 11*c*, and edge 18*a* of partition 11*e* (shown in FIG. 10B) has another shape.

Figure 9A:
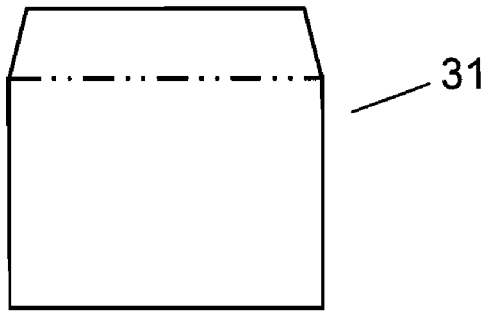
FIG. 9A shows a development view of a resonant element to be used in the filter device shown in FIG. 8.
Figure 9B:
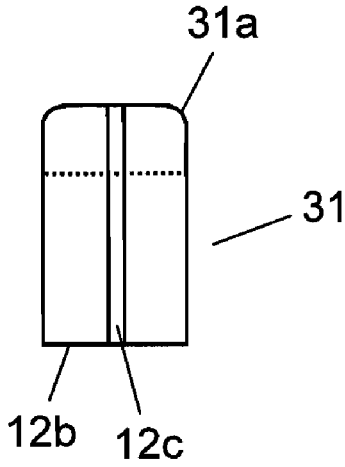
FIG. 9B shows a lateral view of the resonant element shown in FIG. 9A.

FIG. 9A shows a development view of resonant element 31 in accordance with this third embodiment, and FIG. 9B shows a lateral view of resonant element 31. As shown in FIGS. 9A and 9B, the tip of resonant element 31 is bent inside, so that the plated face becomes tip 31*a* of resonant element 31, and no basis metal is exposed at tip 31*a*. Tip 31*a* thus has a smaller resistance, so that an insertion loss of this filter device becomes smaller. The bent length of the tip is approx. 3 mm.

As shown in FIG. 9A, the corners of the bent section are cut so that interference in material when the tip is bent can be reduced, and thus resonant element 31 with accurate dimensions is obtainable.

Figure 10A:
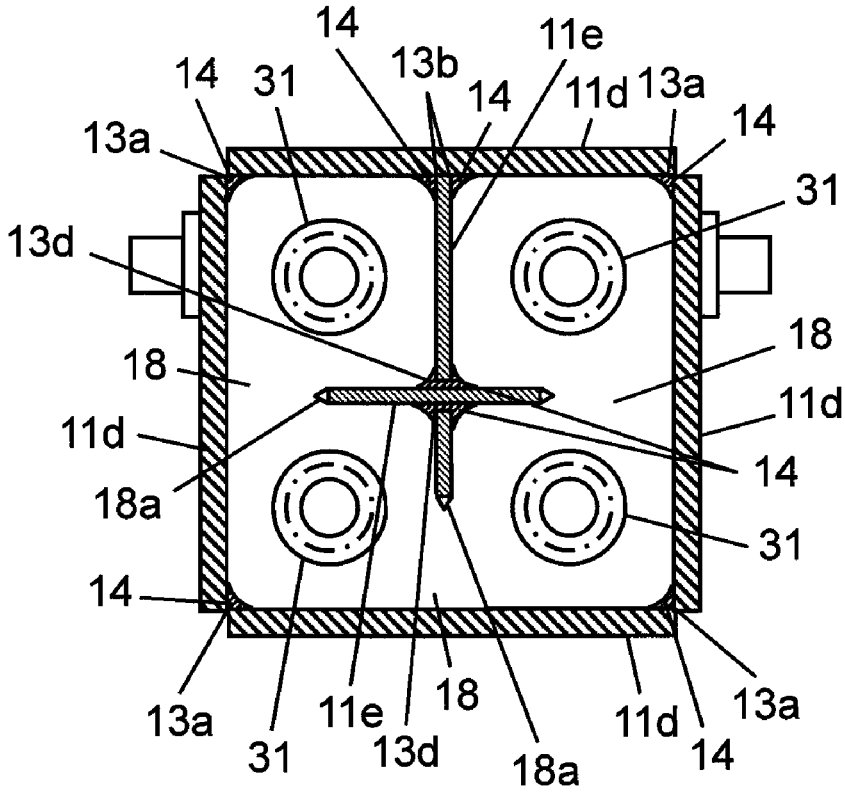
FIG. 10A shows a cross section viewed from the top of the filter device shown in FIG. 8.
Figure 10B:
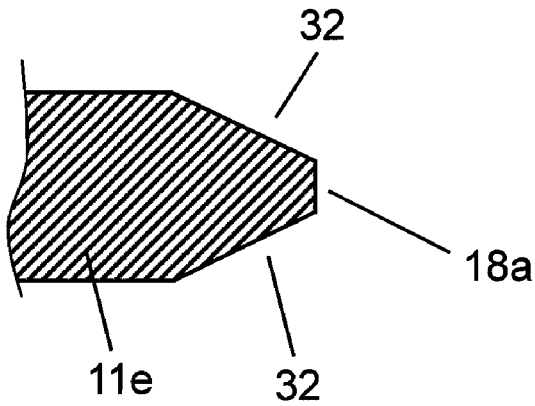
FIG. 10B shows an enlarged sectional view of a tip of a partition of the filter device shown in FIG. 8.

FIG. 10A shows a cross section viewed from the top of a filter device in accordance with the third embodiment, and FIG. 10B shows an enlarged sectional view of the tip of the partition of the same filter device. In FIGS. 10A and 10B, elements similar to those shown in FIG. 1 have the same reference marks, and the descriptions thereof are simplified here.

Communicating windows 18 are provided between the edge 18*a* of partition 11*e* and side plate 11*d* for communicating a cavity with an adjacent cavity, separated by partition 11*e*. Edge 18*a* of partition 11*e* tends to have a higher electric potential. To overcome this drawback, edge 18*a* is pressed from both sides to form V-shaped press-face 32 in the step of press-working so that the plated material can be introduced onto the cut surface. Face 32 is cut around its apex for forming a plated face on press-face 32, so that a smaller area of cut surface can be exposed at edge 18*a* of partition 11*e*.

A smaller resistance is achievable at the place where an electric potential tends to be higher, so that the filter device having a smaller insertion loss is obtainable. In this case, edge 18*a* is preferably covered with solder 14 as discussed previously.

Figure 11:
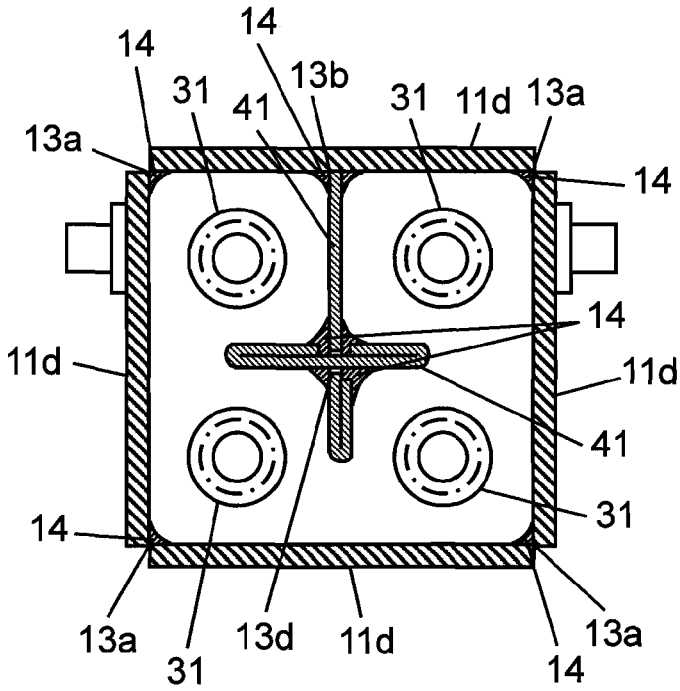
FIG. 11 shows a cross section viewed from the top of a filter device using a partition which is described in a second example of the third embodiment.
Figure 12:
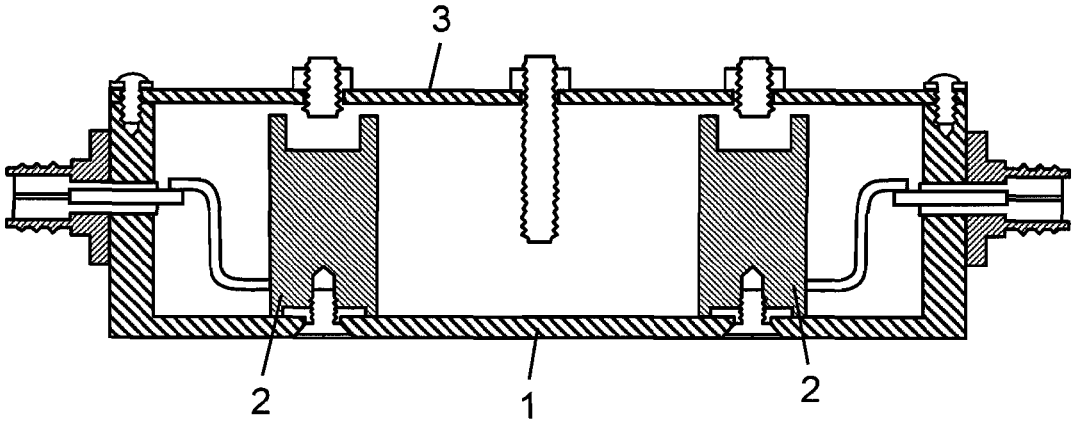
FIG. 12 shows a sectional view of a conventional filter device.

FIG. 11 shows a cross section viewed from the top of the filter device employing the partition, according to a second example of the third embodiment. In FIG. 11, partition 41 is folded over at its edge, so that a plated face becomes the edge, whose resistance thus becomes smaller. As a result, the filter device having a further smaller resistance is obtainable.

The filter device of the present invention has a smaller insertion loss even when a plated metal sheet is used for forming a frame of the filter device, so that excellent productivity can be expected. This filter device is useful in micro wave or semi-micro wave communication apparatuses.

The invention claimed is:

1. A filter device comprising:

a filter housing including a frame having an upward opening in an upper side thereof and a lid covering the upward opening of the frame and mounted to the frame; and a resonant element placed inside the filter housing;

wherein at least an inside of the filter housing is provided with a plated face;

wherein the resonant element employs a steel sheet whose both sides are plated;

wherein the resonant element is shaped into a cylinder by bending the plated steel sheet, and wherein a gap formed on a lateral face of the resonant element is brazed with bonding material, and an outer plated face of the resonant element is brazed to an inner plated face of the filter housing with the bonding material.

2. The filter device of claim 1, wherein a tip of the resonant element is bent inside.

3. The filter device of claim 1, wherein the frame includes a bottom, wherein the frame further includes a first side plate and a second side plate rising from the bottom and being disposed with respect to each other substantially at right angles, wherein the frame is formed by cutting the steel sheet, whose both sides are plated, and wherein an inner plated face of the first side plate is brazed with the bonding material to an inner plated face of the second side plate.

4. The filter device of claim 3, wherein the plated face is introduced onto a cut surface of the first side plate, and the plated face is introduced onto a cut surface of the second side plate.

5. The filter device of claim 3, wherein the frame includes a partition rising from the bottom and placed forming substantially right angles with respect to the first side plate, and a communicating window for communicating a cavity with another cavity, separated by the partition, wherein the partition employs a steel sheet whose both sides are plated, and the plated steel sheet is shaped into the partition by cutting the plated steel sheet, and the partition is brazed with the bonding material to the frame at its both sides.

6. The filter device of claim 1 comprising:

a plurality of resonant elements which are separated by a partition having a communicating window.

7. The filter device of claim 6, wherein at least a part of an edge of the partition on a side of the communicating window is provided with a plated face.

8. The filter device of claim 7, wherein the plated face on the edge of the partition on the side of the communicating window is formed by introducing a plated face of a side face of the partition through press working.

9. The filter device of claim 7, wherein the plated face on the edge of the partition on the side of the communicating window is formed by folding over the partition.

* * * * *